US007853177B2

(12) United States Patent
Bae

(10) Patent No.: US 7,853,177 B2
(45) Date of Patent: Dec. 14, 2010

(54) ELECTROPHOTOGRAPHIC IMAGE FORMING APPARATUS HAVING TRANSPARENT TONER AND PRINTING METHOD THEREOF

(75) Inventor: Jun-cheol Bae, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 368 days.

(21) Appl. No.: 11/775,394

(22) Filed: Jul. 10, 2007

(65) Prior Publication Data

US 2008/0152397 A1 Jun. 26, 2008

(30) Foreign Application Priority Data

Dec. 26, 2006 (KR) ..... 10-2006-0134156

(51) Int. Cl.
*G03G 15/01* (2006.01)
*G03G 15/30* (2006.01)

(52) U.S. Cl. ..... 399/149; 399/344

(58) Field of Classification Search ..... 399/223, 399/231, 344, 358, 359, 149, 150
See application file for complete search history.

(56) References Cited

U.S. PATENT DOCUMENTS 5,652,649 A * 7/1997 Ikegawa et al. ..... 399/175
5,822,657 A * 10/1998 Hisada et al. ..... 399/149
6,678,493 B2 * 1/2004 Maeyama et al. ..... 399/302
2006/0127134 A1 6/2006 Sakamaki et al.
2007/0053726 A1 * 3/2007 Noguchi et al. ..... 399/298

FOREIGN PATENT DOCUMENTS

JP 2003162125 A * 6/2003

OTHER PUBLICATIONS

Machine Translation of JP 2003-162125 A.*

* cited by examiner

*Primary Examiner*—David M Gray
*Assistant Examiner*—Gregory H Curran
(74) *Attorney, Agent, or Firm*—Stanzione & Kim, LLP

(57) ABSTRACT

An electrophotographic image forming apparatus. The apparatus includes first and second photosensitive bodies, first and second exposing units to form electrostatic latent images on the first and second photosensitive bodies respectively charged to a uniform electric potential, a first developing unit to develop an electrostatic latent image of the first photosensitive body by supplying a transparent toner to the electrostatic latent image of the first photosensitive body, and a second developing unit to develop an electrostatic latent image of the second photosensitive body by supplying a color toner to the electrostatic latent image of the second photosensitive body, wherein the first developing unit is a monocomponent cleanerless developing unit.

9 Claims, 4 Drawing Sheets

ELECTROPHOTOGRAPHIC IMAGE FORMING APPARATUS HAVING TRANSPARENT TONER AND PRINTING METHOD THEREOF

CROSS-REFERENCE TO RELATED APPLICATIONS

This application claims priority under 35 U.S.C. §119(a) from Korean Patent Application No. 10-2006-0134156, filed on Dec. 26, 2006, in the Korean Intellectual Property Office, the disclosure of which incorporated herein in its entirety by reference.

BACKGROUND OF THE INVENTION

1. Field of the Invention

The present general inventive concept relates to an image forming apparatus, and more particularly, to an electrophotographic image forming apparatus having a transparent toner and a printing method thereof.

2. Description of the Related Art

Conventional Electrophotographic image forming apparatuses form an electrostatic latent image by scanning light onto a photosensitive body charged to a uniform electric potential, develop the electrostatic latent image with a predetermined color of toner and then transfer and fuse the developed image onto a printing medium, thereby printing a desired image. In general, four colors of toners, such as yellow (Y), magenta (M), cyan (C), and black (B), are used in electrophotographic color image forming apparatuses, and four developing units are used to develop the electrostatic latent image formed on the photosensitive body with these four colors of toners.

A toner is manufactured based on a plastic resin and thus has some gloss. A portion of a printed image to which the toner is attached has some gloss but a background region of the printed image to which the toner is not attached has no gloss. In addition, a higher coverage (i.e., a ratio of an area to which the toner is attached to a total area of the printing medium) of the printed image produces a higher gloss. The gloss of the printed image affects the visual quality of the image. U.S. Patent Publication No. 20060127134 discloses an image forming apparatus featuring a transparent image forming station to improve the gloss of a printed image by employing developing devices for developing electrostatic images with color toners and a developing device for developing an electrostatic image with a transparent toner. In such an image forming apparatus, an amount of a consumed transparent toner is considerably larger than an amount of a consumed color toner.

SUMMARY OF THE INVENTION

The present general inventive concept provides an electrophotographic image forming apparatus which reduces an amount of a consumed transparent toner and improves utilization efficiency of the transparent toner, and a printing method thereof.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an electrophotographic image forming apparatus including first and second photosensitive bodies, first and second exposing units to form electrostatic latent images on the first and second photosensitive bodies respectively charged to a uniform electric potential, a first developing unit to develop a first electrostatic latent image of the first photosensitive body by supplying a transparent toner to the first electrostatic latent image of the first photosensitive body, and a second developing unit to develop second electrostatic latent images of the second photosensitive body by supplying a color toner to the second electrostatic latent images of the second photosensitive body, wherein the first developing unit is a mono-component cleanerless developing unit.

The second electrostatic latent image may include a plurality of second sub-electrostatic latent images, the second photosensitive body may include a plurality of second sib-photosensitive bodies, the second exposing unit may include a plurality of second exposing units to form the second sub-electrostatic latent images on the plurality of the second sub-photosensitive bodies, and the second developing unit may include a plurality of second developing units to develop the second sub-electrostatic latent images on the plurality of the second sub-photosensitive bodies by supplying different color toners to corresponding ones of the second sub-electrostatic latent images.

The apparatus may further include a transfer medium to which a transparent toner image and color toner images respectively formed on the first photosensitive body and the plurality of the second sub-photosensitive bodies are transferred, and a cleaning member to eliminate a toner that remains on the transfer medium after the transferred transparent toner image and color toner images are finally transferred. The first photosensitive body may be positioned on an upperstream side than the plurality of the second sub-photosensitive bodies in a progressive direction of the transfer medium. The first developing unit may be a contact developing unit in which a developing roller is in contact with the first photosensitive body and performs a developing operation. An average electric potential of a developing bias voltage to be applied to the developing roller of the first developing unit may be between a surface electric potential of a non-image portion of the first electrostatic latent image on the first photosensitive body and a surface electric potential of an image portion of the first electrostatic latent image on the first photosensitive body.

The foregoing and/or other aspects and utilities of the present general inventive concept may also be achieved by providing an electrophotographic image forming apparatus including a photosensitive body, an exposing unit, a first developing unit in which a transparent toner is accommodated, a plurality of second developing units in which different color toners are accommodated, and a transfer medium to which a transparent toner image and color toner images sequentially developed on the photosensitive body are sequentially transferred, the apparatus further including a cleaning member to eliminate a toner that remains while being in contact with the photosensitive body, wherein the cleaning member is separated from the photosensitive body while a developing operation is performed by the first developing unit.

The foregoing and/or other aspects and utilities of the present general inventive concept may also be achieved by providing a printing method of an electrophotographic image forming apparatus, the method including transferring color toners and a transparent toner to a transfer medium, forming color toner images and a transparent toner image and then finally transferring the color toner images and the transparent toner image to a printing medium, thereby printing an image, wherein the forming of the transparent toner image includes forming a transparent toner image by supplying a transparent toner to an electrostatic latent image of a photosensitive body from a developing unit and transferring the transparent toner image to the transfer medium, and recovering the transparent toner that remains on a non-image portion of the photosensitive body after the transfer operation into the developing roller by a difference between a surface electric potential of the photosensitive body formed by charging and exposure after the transfer operation and an electric potential of a developing bias voltage applied to a developing roller of the developing unit.

The foregoing and/or other aspects and utilities of the present general inventive concept may also be achieved by providing a method of image forming apparatus, including forming a first electrostatic latent image corresponding to a transparent toner on a first photosensitive body, forming a plurality of second electrostatic latent images corresponding to various colored toners on a plurality of second photosensitive bodies which each have a charging electric potential less than an absolute value of a charging electric potential of the first photosensitive body, and transferring the transparent toner and the colored toners to a printing medium to form an image on the printing medium corresponding to the first and second electrostatic latent images.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
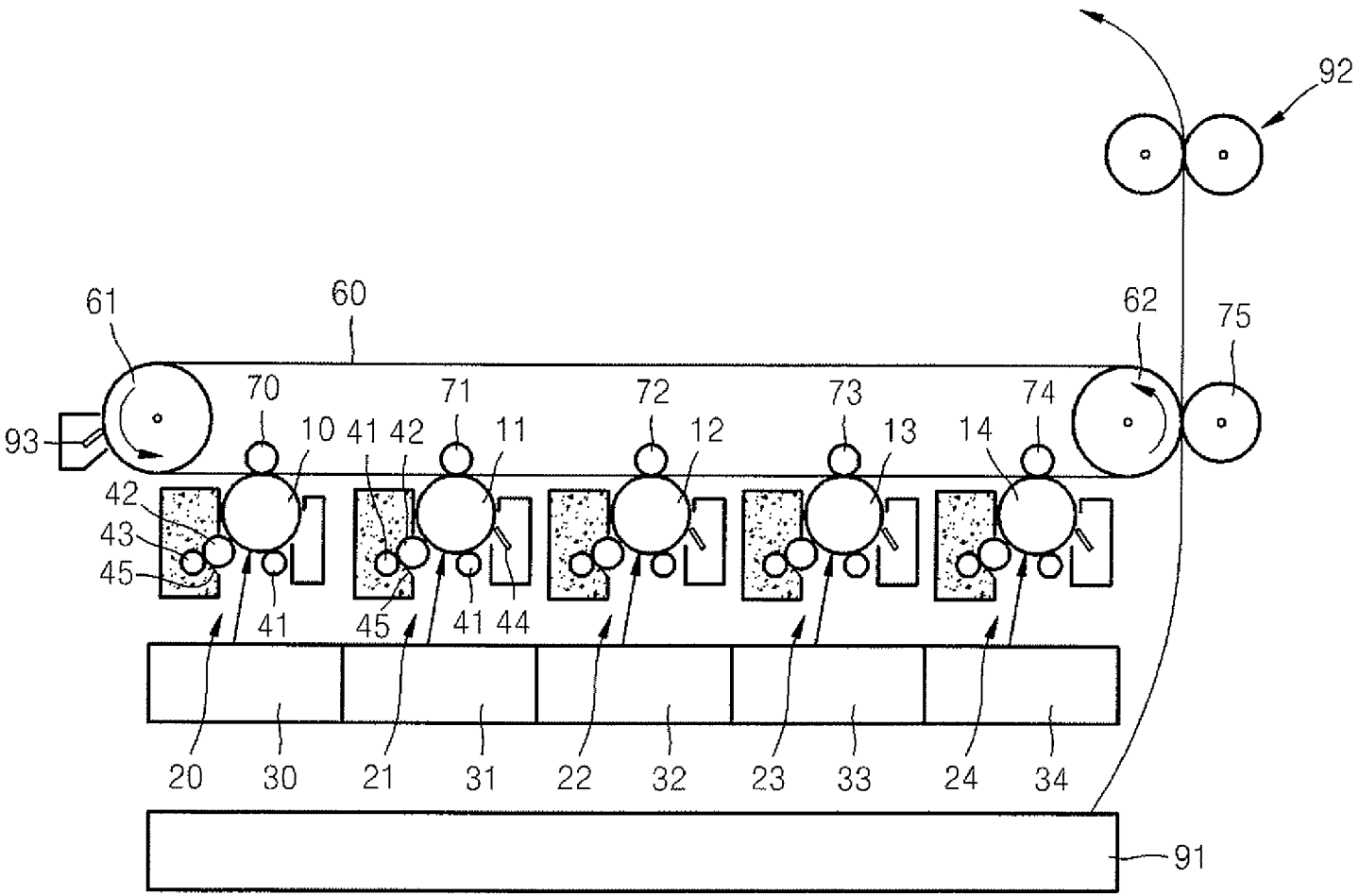
FIG. 1 illustrates a single pass color image forming apparatus which is a type of an electrophotographic image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 illustrates an electrophotographic image forming apparatus according to an embodiment of the present general inventive concept. Referring to FIG. 1, the electrophotographic image forming apparatus according to the present embodiment is a single pass color image forming apparatus which includes a first photosensitive drum 10, a first exposing unit 30, and a first developing unit 20, which are used to develop a transparent toner image, and second photosensitive drums 11, 12, 13, and 14, second exposing units 31, 32, 33, and 34, and second developing units 21, 22, 23, and 24 which are used to develop color toner images.

A transparent toner is accommodated in the first developing unit 20. Color toners such as black (B), magenta (M), cyan (C), and yellow (Y) are accommodated in the second developing units 21, 22, 23, and 24, respectively.

The color toners and the transparent toner according to the present embodiment are mono-component toners. A colorant which causes a change in color of a binder resin, internal additives such as charge control agent (CCA), wax, etc., and external additives such as silica and titanium oxide ($TiO_2$) are added to the color toners. Composition of the transparent toner is almost identical as composition of the color toners except for the colorant and the additives to adjust gloss. The color toners and the transparent toner can be charged to a negative (−) or positive (+) polarity. Charging of the color toners and the transparent toner to a negative (−) polarity will now be described. Charging amounts of the color toners and the transparent toner are about −10 to −25 μC/g measured in suction type Faraday Gauge, and a layer of toner on a developing roller 42 is about 0.5 to 1 mg/cm$^2$.

The first photosensitive drum 10 and the second photosensitive drums 11, 12, 13, and 14 correspond to the first developing unit 20 and the second developing units 21, 22, 23, and 24, respectively.

The first exposing unit 30 and each of the second exposing units 31, 32, 33, and 34 scans light modulated according to image information about transparent (T), black (B), magenta (M), cyan (C), and yellow (Y) colors, respectively, onto the first photosensitive drum 10 and the second photosensitive drums 11, 12, 13, and 14, and thereby forms electrostatic latent images. A laser scanning unit (LSU) that uses a laser diode as a light source, is usually used as each of the first and second exposing units 30, 31, 32, 33, and 34.

Each of charging rollers 41 is an example of a charging unit to charge each of the first photosensitive drum and the second photosensitive drums 11, 12, 13, and 14 to a uniform surface electric potential. The charging rollers 41 are in contact with the first and second photosensitive drums 10, 11, 12, 13, and 14, respectively. A charging bias voltage is applied to each of the charging rollers 41.

The first developing unit 20 and each of the second developing units 21, 22, 23, and 24 include a developing roller 42 and a supply roller 43. The supply roller 43 attaches the toner accommodated in each of the first and second developing units 20, 21, 22, 23, and 24 to the developing roller 42. The first and second developing units 20, 21, 22, 23, and 24 may further include a regulating unit 45 to regulate an amount of the toner attached to a surface of the developing roller 42 to form a layer of toner having a uniform thickness. For example, the regulating unit 45 may be an elastic plate or roller which is elastically in contact with the developing roller 42. In addition, the first and second developing units 20, 21, 22, 23, and 24 may further include at least one carrying unit (not illustrated) to carry the toner accommodated in each of the first and second developing units 20, 21, 22, 23, and 24 into a region in which the developing roller 42 and the supply roller 43 face each other. When a contact developing technique is used, the developing rollers 42 are in contact with the first and second photosensitive drums 10, 11, 12, 13, and 14. A developing bias voltage, which is used to supply the toners accommodated in each of the first and second developing units 20, 21, 22, 23, and 24 to electrostatic latent images of the first and second photosensitive drums 10, 11, 12, 13, and 14, is applied to each of the developing rollers 42. Due to the developing bias voltage, an electric potential difference between the developing rollers 42 and the electrostatic latent images is produced so that the toners are detached from the surface of the developing rollers 42 and are attached to the electrostatic latent images, and the electrostatic latent images are developed with the toners. When a non-contact developing technique is used, each of the developing rollers 42 is positioned to maintain a developing gap between each of the first and second photosensitive drums 10, 11, 12, 13, and 14, and for example, a bias voltage in which an AC current and a DC current are mixed, may be used as a developing bias voltage. The above-mentioned contact developing technique will now be described.

An intermediate transfer belt 60 is an example of an intermediate transfer medium to which toner images developed on the first and second photosensitive drums 10, 11, 12, 13, and 14 are temporarily transferred. The intermediate transfer belt 60 faces the first and second photosensitive drums 10, 11, 12, 13, and 14, is supported by support rollers 61 and 62, and travels circulatively in a recording medium transfer direction. A first transfer roller 70 faces the first photosensitive drum 10 in a state where the intermediate transfer belt 60 is placed therebetween. Each of second transfer rollers 71, 72, 73, and 74 faces each of the second photosensitive drums 11, 12, 13, and 14 in a state where the intermediate transfer belt 60 is placed therebetween. A first transfer bias voltage, which is used to attach the toner images developed on the first and second photosensitive drums 10, 11, 12, 13, and 14 to the intermediate transfer belt 60, is applied to each of the first and second transfer rollers 70, 71, 72, 73, and 74. For example, a conductive metal roller or a rubber roller in which a semi-conductive rubber having elasticity is put on a metal shaft may be used as each of the first and second transfer rollers 70, 71, 72, 73, and 74.

A final transfer roller 75 is positioned to face the intermediate transfer belt 60. A printing medium stacked on a paper feeding cassette 91 is carried by a carrying unit (not illustrated) between the final transfer roller 75 and the intermediate transfer belt 60. A second transfer bias voltage, which is used to transfer the toner images attached to the intermediate transfer belt 60 to the printing medium, is applied to the final transfer roller 75. A fusing unit 92 fuses the toner images onto the printing medium by applying heat and pressure to the printing medium.

A cleaning blade 44 is an example of a cleaning unit which eliminates the toner remaining on the surface of each of the second photosensitive drums 11, 12, 13, and 14 after an intermediate transfer operation.

The present general inventive concept is characterized in that, in order to reduce an amount of a consumed transparent toner and to improve utilization efficiency of the transparent toner, transparent toner that remains on the first photosensitive body 10 after a transfer operation is recovered and re-used instead of being discarded. In particular, the present general inventive concept is characterized in that the transparent toner is recovered into the first developing unit 20 using the developing roller 42 and the developing bias voltage applied to the developing roller 42 so that the transparent toner is recovered without an additional recovery device. Accordingly, the first developing unit 20 is a cleanerless developing unit having no cleaning means unlike the second developing units 21, 22, 23, and 24.

Operation of the above-described structure and effects thereof will now be described.

When a printing instruction is input from a computer of other input device (not illustrated), image information is processed to image information about transparent (T), black (B), magenta (M), cyan (C), and yellow (Y) colors by a control unit (not illustrated). Image information about a transparent (T) color may be image information, which is used to develop a transparent toner image in a region which corresponds to a background portion of an image in which color toners such as black (B), magenta (M), cyan (C), and yellow (Y) are not attached. In order to make gloss of the printed image uniform, image information about the transparent (T) color may be image information, which is used to develop a transparent toner image in a region in which the amount of attachment of color toners of black (B), magenta (M), cyan (C), and yellow (Y) is low and in a region which corresponds to the background portion of the image.

Figure 2:
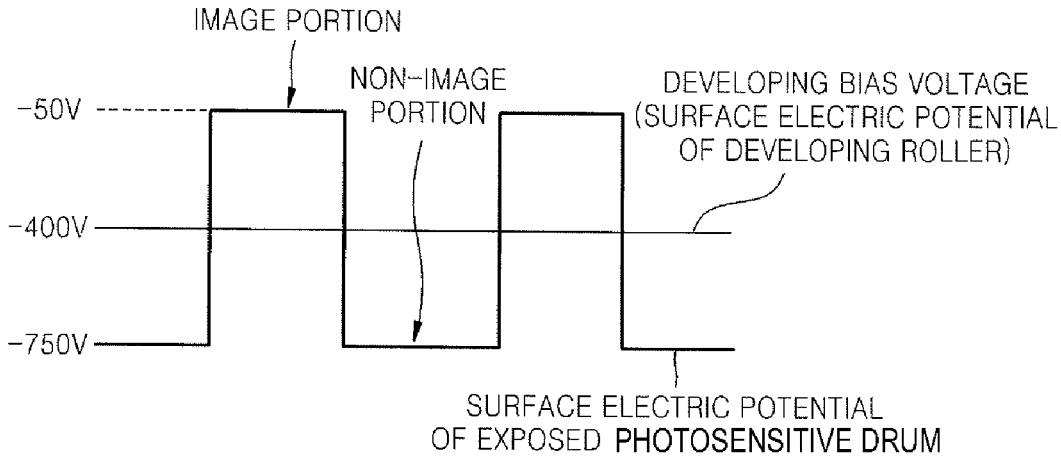
FIG. 2 illustrates an electric potential of a surface of an exposed photosensitive drum.

According to the image information about the transparent (T) color, the first exposing unit 30 scans light onto the first photosensitive drum 10 charged by the charging roller 41 to a uniform electric potential and thereby forms an electrostatic latent image. For example, the surface electric potential of the first photosensitive drum 10 charged by the charging roller 41 is approximately −750V, as illustrated in FIG. 2. The electric potential of an image portion onto which light is scanned by the first exposing unit 30 is approximately −50V. A non-image portion onto which light is not scanned is maintained at the surface electric potential of the charged first photosensitive drum 10. The average electric potential of the developing bias voltage to be applied to each developing roller 42 of the first developing unit 20 is between the electric potential of the image portion and the electric potential of the non-image portion, for example, −400 V. Since transparent toner is charged to a negative (−) polarity, when the developing bias voltage is applied to the developing roller 42, the transparent toner accommodated in the first developing unit 20 is attached to the image portion. A first transfer bias voltage having an opposite polarity to the charging polarity of the transparent toner is applied to the first transfer roller 70. As such, the transparent toner image developed on the first photosensitive drum 10 is transferred onto the intermediate transfer belt 60.

Figure 3:
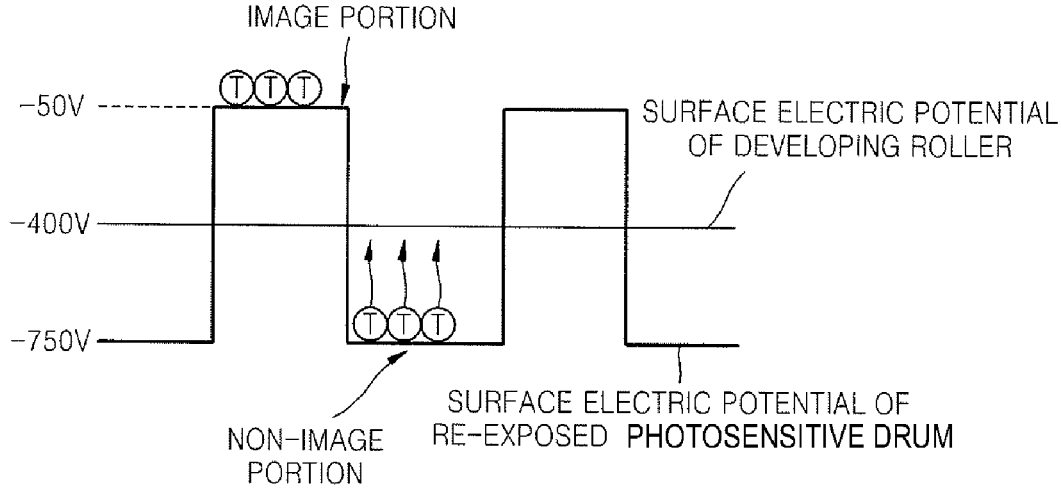
FIG. 3 illustrates an operation of recovering a transparent toner that remains on a first photosensitive drum after an intermediate transfer operation using a first developing unit.

All of the transparent toner image is not transferred onto the intermediate transfer belt 60 but part of the transparent toner image remains on the surface of the first photosensitive drum 10. Since the first developing unit 20 does not include a cleaning unit, the remaining transparent toner is not removed. The surface of the first photosensitive drum 10 is uniformly charged by the charging roller 41 to −750 V and is exposed by the first exposing unit 30. As illustrated in FIG. 3, in the developing region in which the developing roller 42 and the first photosensitive drum 10 face each other, the remaining transparent toner attached to a location corresponding to the image portion by re-exposure remains on the surface of the first photosensitive drum 10. However, since a developing bias voltage of −400 V is applied to the developing roller 42, the remaining transparent toner attached to a region corresponding to the non-image portion by re-exposure moves to the surface of the developing roller 42 which has a higher electric potential than the region corresponding to the non-image portion by re-exposure. As such, the remaining transparent toner on the first photosensitive drum 10 can be recovered into the first developing unit 20 and re-used so that utilization efficiency of the transparent toner can be improved.

Next, according to the image information about the black (B) color, the second exposing unit 31 scans light onto the second photosensitive drum 11 charged by the charging roller 41 to a uniform electric potential and thereby forms an electrostatic latent image. For example, the surface electric potential, of the second photosensitive drum 11 charged by the charging roller 41 is identical to the surface electric potential of the second photosensitive drum 11 that is illustrated in FIG. 2. The electric potential of an image portion in which light is scanned by the second exposing unit 31 is approximately −50 V. A non-image portion in which light is not scanned by the second exposing unit 31 is maintained to the electric potential of the surface of the charged second photosensitive drum 11. The average electric potential of the developing bias voltage to be applied to each developing roller 42 of the second developing unit 21 is between the electric potential of the image portion and the electric potential of the non-image portion. Since black toner is charged to a negative (−) polarity, when the developing bias voltage is applied to the developing roller 42, the black toner accommodated in the second developing unit 21 is attached to the image portion. A first transfer bias voltage having an opposite polarity to the charging polarity of the black toner is applied to the second transfer roller 71. As such, the black toner image developed on the second photosensitive drum 11 is transferred onto the intermediate transfer belt 60. The black toner that remains on the second photosensitive drum 11 after a transfer operation is eliminated by the cleaning blade 44.

The same operation as described above is performed by the second photosensitive drums 12, 13, and 14, the second exposing units 32, 33, and 34, and the second developing units 22, 23, and 24, respectively, at time intervals each of which is given by the formula (distance between photosensitive drums)/(carrying speed of intermediate transfer belt), so as to meet color registration requirements.

Through the above-described operations, the toner images of black (B), magenta (M), cyan (C), yellow (Y), and transparent (T) colors are sequentially stacked on the intermediate transfer belt 60. When the various toner images reach a region in which the final transfer roller 75 and the intermediate transfer belt 60 face each other, the printing medium supplied from the paper feeding cassette 91 reaches the region to begin a printing operation. A second transfer bias voltage having an opposite polarity to the charging polarities of the transparent toner image and the color toner images are applied to the final transfer roller 75. Then, the toner images are transferred to the printing medium. When the printing medium passes the fusing unit 92, the transparent toner image and the color toner images are fused on the printing medium by heat and pressure and the printing operation is ended. Since the toners that are not transferred to the printing medium and remain on the intermediate transfer belt 60 are eliminated by a cleaning member 93, the transparent toner and the color toners are not mixed in the first and second developing units 20, 21, 22, 23, and 24 through the first and second photosensitive drums 10, 11, 12, 13, and 14.

A difference in gloss between the region in which the black (B), magenta (M), cyan (C), and yellow (Y) toner images are attached and the background region can be reduced through the above-described operations so that the quality of the printed image can be improved. In addition, the transparent toner whose consumed amount is large is recovered and reused so that the utilization efficiency of the transparent toner can be improved.

In order to improve recovery efficiency of the transparent toner, the first developing unit 20 may be a contact developing unit in which the developing roller 42 and the first photosensitive drum 10 are in contact with each other. In addition, in order to improve the recovery efficiency of the transparent toner, an absolute value of the charging electric potential of the first photosensitive drum 10 may be larger than the absolute value of the charging electric potential of each of the second photosensitive drums 11, 12, 13, and 14. In other words, the first photosensitive drum 10 may be charged to −900 V, for example. As such, the remaining transparent toner attached to the non-image portion can be more easily recovered into the developing roller 42 by making an electric potential difference between the developing bias voltage and the non-image portion. Each of the second developing units 21, 22, 23, and 24 may use a contact developing technique in which the developing roller 42 and each of the second photosensitive drums 11, 12, 13, and 14 contact each other, or a non-contact developing technique in which the developing roller 42 and each of the second photosensitive drums 11, 12, 13, and 14 are separated from each other by a developing gap. In addition, each of the second developing units 21, 22, 23, and 24 may be a two-component developing unit using a two-component developing agent in which a carrier and a toner are mixed.

The transparent toner image may be firstly developed and transferred onto the intermediate transfer belt 60 so that the color toners are not mixed in the first developing unit 20 while the remaining transparent toner is recovered from the first photosensitive drum 10 into the first developing unit 20. That is, the first photosensitive drum 10 may be positioned on an upperstream side of the image forming apparatus, rather than a side of the image forming apparatus corresponding the plurality of the second photosensitive drums 11, 12, 13, and 14 which are disposed in a progressive direction of the intermediate transfer belt 60.

Figure 4:
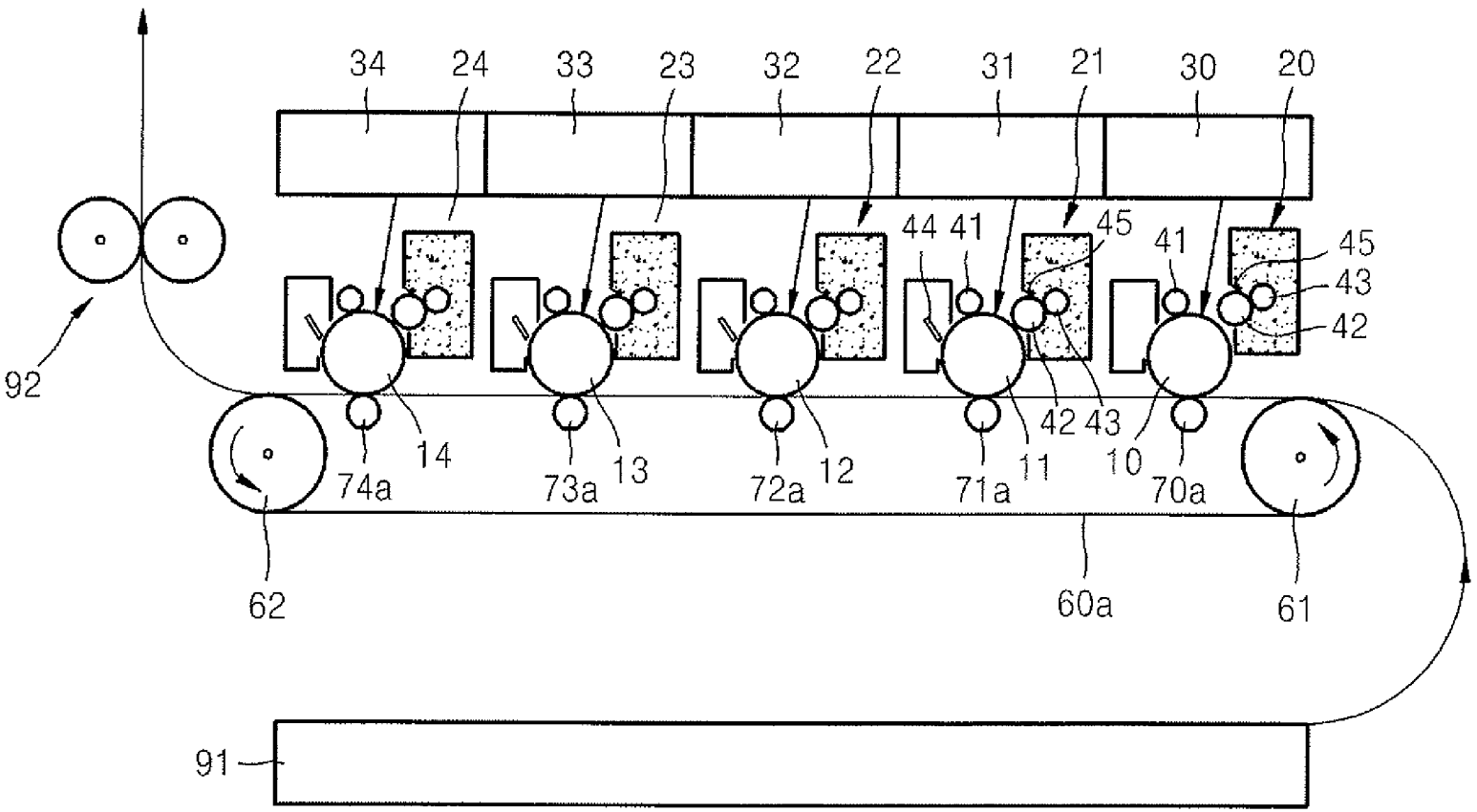
FIG. 4 illustrates a single pass color image forming apparatus employing a direct transfer technique which is a type of an electrophotographic image forming apparatus according to another embodiment of the present general inventive concept.

The above-described technique of developing the transparent toner may also be applied to a single pass image forming apparatus to perform a direct transfer technique in which a toner image is directly transferred to the printing medium without an intermediate transfer operation, as illustrated in FIG. 4. Referring to FIG. 4, the printing medium withdrawn from the paper feeding cassette 91 is carried by a carrying belt 60*a*. Each of a plurality of transfer rollers 70*a*, 71*a*, 72*a*, 73*a*, and 74*a* faces each of the first and second photosensitive drums 10, 11, 12, 13, and 14 in a state where the printing medium and the carrying belt 60*a* are placed therebetween. The transparent toner image and the color toner images respectively developed on the first and second photosensitive drums 10, 11, 12, 13, and 14 are directly transferred to the printing medium by a transfer bias voltage applied to each of the transfer rollers 70*a*, 71*a*, 72*a*, 73*a*, and 74*a*.

Figure 5:
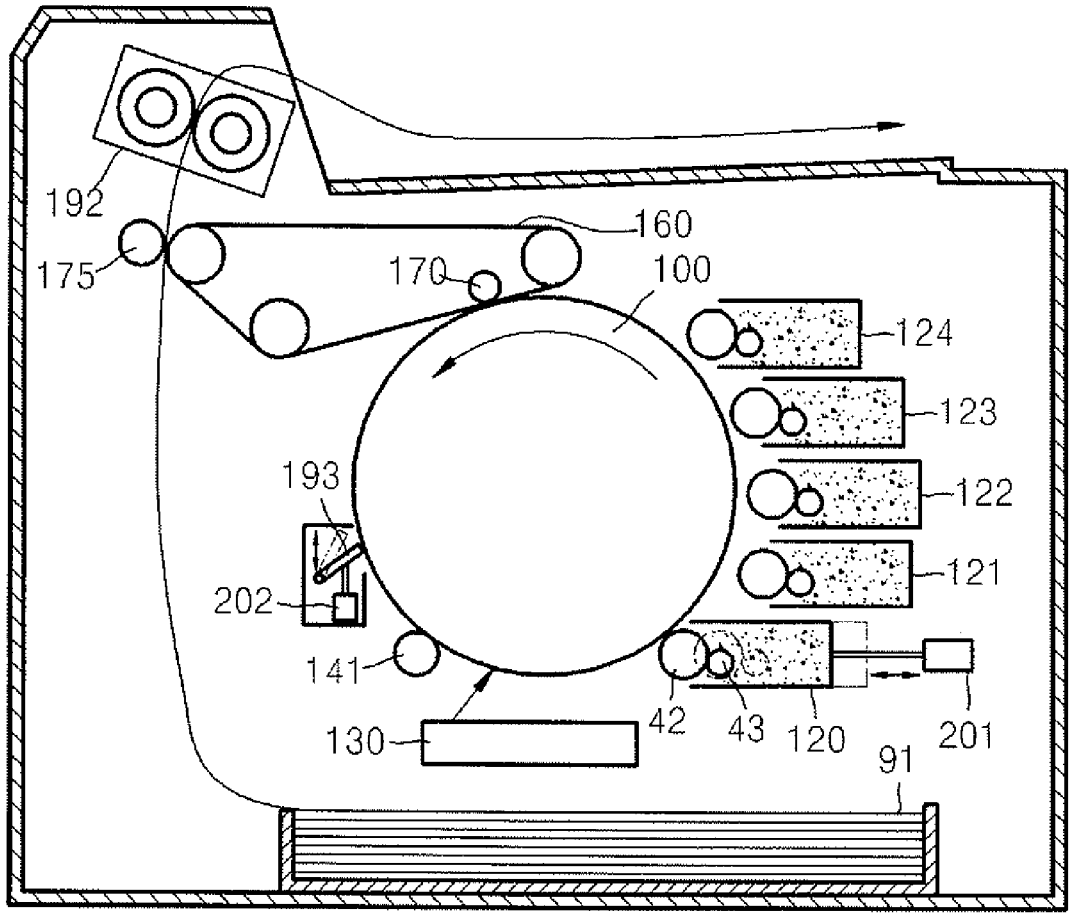
FIG. 5 illustrates a multiple pass color image forming apparatus which is a type of an electrophotographic image forming apparatus according to another embodiment of the present general inventive concept.

The above-described technique of developing the transparent toner may also be applied to a multiple pass image forming apparatus. FIG. 5 illustrates an electrophotographic image forming apparatus according to another embodiment of the present general inventive concept. The electrophotographic image forming apparatus according to the present embodiment including a photosensitive drum 100, an exposing unit 130, a first developing unit 120 to develop a transparent toner image, and four second developing units 121, 122, 123, and 124 to develop color toner images. Referring to FIG. 5, the first and second developing units 120, 121, 122, 123, and 124 are disposed around the photosensitive drum 100. A transparent toner is accommodated in the first developing unit 120. Color toners such as black (B), magenta (M), cyan (C), and yellow (Y) are accommodated in the second developing units 121, 122, 123, and 124, respectively.

The exposing unit 130 scans light onto the photosensitive drum 100 charged by a charging roller 141 to a uniform electric potential according to black (B) image information, and thereby forms an electrostatic latent image corresponding to black (B) on a surface of the photosensitive drum 100. When a black (B) toner is supplied to the electrostatic latent image by the first developing unit 121, a black toner image is formed on the surface of the photosensitive drum 100. The black (B) toner image is transferred onto an intermediate transfer belt 160 by a first transfer bias voltage applied to an intermediate transfer roller 170. A cleaning member 193 eliminates the black toner image that remains on the photosensitive drum 100 after a transfer operation. When the black toner image which corresponds to a sheet of paper is transferred onto the intermediate transfer belt 100, toner images of magenta (M), cyan (C), and yellow (Y) colors are sequentially transferred onto the intermediate transfer belt 160.

Next, the exposing unit 130 scans light onto the photosensitive drum 100 charged by a charging roller 141 to a uniform electric potential according to transparent (T) image information, for example, and thereby forms an electrostatic latent image corresponding to the transparent (T) color on the surface of the photosensitive drum 100. A transparent toner image is formed on the surface of the photosensitive drum 100 by a transparent toner supplied by the first developing unit 120. The transparent toner image is transferred onto the intermediate transfer belt 160 by the first bias voltage applied to the intermediate transfer roller 170. As such, toner images are formed on the intermediate transfer belt 160. The toner images are transferred by using a final transfer roller 175 and are fused on a fusing unit 192 so that color images having improved gloss can be printed. The present general inventive concept is characterized by an improvement in utilization efficiency of the transparent toner. Thus, the scope of the present general inventive concept is not limited by the above-described developing sequence of magenta (M), cyan (C), yellow (Y), and transparent (T) toners.

All of the transparent toner image is not transferred onto the intermediate transfer belt 160, but part of the transparent toner image remains on the surface of the first photosensitive drum 100. The cleaning member 193 is separated from the photosensitive drum 100 while the transparent toner image is developed on the photosensitive drum 100. Thus, the transparent toner that remains on the surface of the photosensitive drum 100 is not removed. As the photosensitive drum 100 is rotated, the surface of the photosensitive drum 100 that escapes from a region in which the intermediate transfer belt 160 and the photosensitive drum 100 face each other is uniformly charged by the charging roller 141 to −750 V, and is exposed by the exposing unit 130. In the developing region in which the developing roller 42 and the photosensitive drum 100 face each other, the remaining transparent toner attached to a position corresponding to the image portion by re-exposure remains on the surface of the photosensitive drum 100. However, since a developing bias voltage of −400 V is applied to the developing roller 42, the remaining transparent toner attached to a region corresponding to the non-image portion by re-exposure moves to the surface of the developing roller 42, which has a higher electric potential than the region corresponding to the non-image portion by re-exposure. As such, the remaining transparent toner on the photosensitive drum 100 can be recovered into the first developing unit 120, and can be re-used so that the utilization efficiency of the transparent toner can be improved and toner waste can be minimized.

In order to improve the recovery efficiency of the transparent toner, the first developing unit 120 may be a contact developing unit, in which the developing roller 42 and the photosensitive drum 100 contact each other. When the developing roller 42 of the first developing unit 120 continuously contacts the surface of the photosensitive drum 100, the color toner images developed while the developing operation is performed by each of the second developing units 121, 122, 123, and 124 may be mixed in the first developing unit 120. In addition, when the first developing unit 120 is positioned on a lower stream side with respect to each of the second developing units 121, 122, 123, and 124 in a rotation direction of the photosensitive drum 100, the color toner images developed on the photosensitive drum 100 may be disturbed while the developing operation is performed by each of the second developing units 121, 122, 123, and 124. Thus, while not performing the developing operation, the first developing unit 120 moves to a stoppage location in which the developing roller 42 is separated from the photosensitive drum 100. While performing the developing operation, the first developing unit 120 moves to a developing location in which the developing roller 42 is in contact with the photosensitive drum 100. The cleaning member 193 is separated from the photosensitive drum 100 when the first developing unit 120 is positioned in the developing location. Accordingly, the image forming apparatus may further include a first actuator 201 to move the first developing unit 120 and a second actuator 202 to move the cleaning member 193. The first and second actuators 201 and 202 may be solenoids, for example.

In addition, in order to improve the recovery efficiency of the transparent toner, an absolute value of a charging electric potential of the photosensitive drum 100 when the transparent toner image is developed may be larger than an absolute value of a charging electric potential of the photosensitive drum 100 when the color toner images are developed. As such, the remaining transparent toner attached to the non-image portion can be more easily recovered into the developing roller 42 by making an electric potential difference between the developing bias voltage and the non-image portion. Each of the second developing units 121, 122, 123, and 124 may use one of a contact developing technique in which the developing roller 42 and the photosensitive drum 100 are in contact with each other, or a non-contact developing technique in which the developing roller 42 and the photosensitive drum 100 are separated from each other by a developing gap. When a contact developing unit is used as each of the second developing units 121, 122, 123, and 124, each of the second developing units 121, 122, 123, and 124 may move to the developing location and the stoppage location, like the first developing unit 120.

Only the color image forming apparatus employing a plurality of second developing units has been described in the above-described embodiments. However, the scope of the present general inventive concept is also not limited to this. The present general inventive concept may also be applied to a single color image forming apparatus employing one second developing unit. In addition, the scope of the present general inventive concept is not limited by the above-described developing sequence of black (B), magenta (M), cyan (C), and yellow (Y) toners.

As described above, in an electrophotographic image forming apparatus according to an embodiment of the present general inventive concept, transparent toner that remains on a photosensitive body without an additional recovery device can be recovered into a developing unit such that an amount of a consumed transparent toner is reduced and utilization efficiency of the transparent toner is improved.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An electrophotographic image forming apparatus, comprising:

first and second photosensitive bodies;

first and second charging units to charge the first and second photosensitive bodies;

first and second exposing units to form first and second electrostatic latent images on the first and second photosensitive bodies;

a first developing unit to develop the first electrostatic latent image of the first photosensitive body to form a transparent toner image by supplying a transparent toner to the first electrostatic latent image of the first photosensitive body; and a second developing unit to develop the second electrostatic latent image of the second photosensitive body to form a color toner image by supplying a color toner to the second electrostatic latent image of the second photosensitive body; and a transfer unit to transfer the transparent toner image and the color toner image onto a recording medium, wherein the first developing unit is a mono-component cleanerless developing unit while the second developing unit comprises at least one cleaning unit, such that the transparent toner that remains on the first photosensitive body after a transfer operation is recovered into the first developing unit by a difference between a surface electric potential of a non-image portion of the first photosensitive body formed by next charging operation and exposure operation after the transfer operation and an electric potential of a developing bias voltage applied to a developing roller of the first developing unit.

2. The apparatus of claim 1, wherein:

the second electrostatic latent image comprises a plurality of second sub-electrostatic latent images;

the second photosensitive body comprises a plurality of second sub-photosensitive bodies;

the second exposing unit comprises a plurality of second sub-exposing units to form the second sub-electrostatic latent images on the plurality of the second sub-photosensitive bodies; and the second developing unit comprises a plurality of second sub-developing units to develop the second sub-electrostatic latent images on the plurality of the second sub-photosensitive bodies by supplying different color toners to corresponding ones of the second sub-electrostatic latent images.

3. The apparatus of claim 2, further comprising:

a transfer medium to which the transparent toner image and the color toner images respectively formed on the first photosensitive body and the plurality of the second sub-photosensitive bodies are transferred; and a cleaning member to eliminate a toner that remains on the transfer medium after the transferred transparent toner image and color toner images are finally transferred.

4. The apparatus of claim 3, wherein the first photosensitive body is positioned on an upper stream side with respect to the plurality of the second sub-photosensitive bodies in a progressive direction of the transfer medium.

5. The apparatus of claim 1, wherein the first developing unit is a contact developing unit in which a developing roller is in contact with the first photosensitive body and performs a developing operation.

6. The apparatus of claim 5, wherein an absolute value of a charging electric potential of the first photosensitive body is larger than an absolute value of a charging electric potential of the second photosensitive body.

7. The apparatus of claim 5, wherein an average electric potential of a developing bias voltage to be applied to the developing roller of the first developing unit is between a surface electric potential of a non-image portion of the first electrostatic latent image on the first photosensitive body and a surface electric potential of an image portion of the first electrostatic latent image on the first photosensitive body.

8. A printing method of an electrophotographic image forming apparatus, the method comprising:

forming a first electrostatic image and second electrostatic images on a charged surface of a first photosensitive body and charged surfaces of second photosensitive bodies by an exposure process;

forming color toner images and a transparent toner image by supplying color toners and a transparent toner to a first electrostatic latent image of a first photosensitive body and second electrostatic images on a second photosensitive bodies from a cleanerless first developing unit and second developing units, such that each second developing unit comprises a cleaning unit;

transferring the color toner images and the transparent toner image to a transfer medium; and recovering the transparent toner that remains on the first photosensitive body after the transfer operation into the first developing unit by a difference between a surface electric potential of a non-image portion of the first photosensitive body formed by next charging and exposure after the transfer operation and an electric potential of a developing bias voltage applied to the developing roller of the first developing unit.

9. A method of an image forming apparatus, comprising:

forming a first electrostatic latent image corresponding to a transparent toner on a cleanerless first photosensitive body;

forming a plurality of second electrostatic latent images corresponding to various colored toners on a plurality of second photosensitive bodies which each have a cleaning unit as well as a charging electric potential less than an absolute value of a charging electric potential of the first photosensitive body; and transferring the transparent toner and the colored toners to a printing medium to form an image on the printing medium corresponding to the first and second electrostatic latent images.

* * * * *